US005334224A

United States Patent [19]

Sando et al.

[11] Patent Number: 5,334,224

[45] Date of Patent: Aug. 2, 1994

[54] METHOD FOR CONTINUOUS PRETREATMENT OF A CLOTH

[75] Inventors: Yoshiteru Sando; Eiichi Nakano; Hiroshi Ishidoshiro; Koji Sando, all of Wakayama, Japan

[73] Assignee: Sando Iron Works Co., Ltd., Wakayama, Japan

[21] Appl. No.: 25,841

[22] Filed: Mar. 3, 1993

[30] Foreign Application Priority Data

Mar. 11, 1992 [JP] Japan ..... 4-052680

[51] Int. Cl.[5] ..... D06L 3/08

[52] U.S. Cl. ..... 8/108.1; 8/138; 8/139

[58] Field of Search ..... 8/108.1, 138, 139

[56] References Cited

U.S. PATENT DOCUMENTS 3,377,131 4/1968 Cerana ..... 8/139

FOREIGN PATENT DOCUMENTS 2058602 4/1981 United Kingdom .

*Primary Examiner*—John Niebling
*Assistant Examiner*—Edna Wong
*Attorney, Agent, or Firm*—McAulay Fisher Nissen Goldberg & Kiel

[57] ABSTRACT

A method for the pretreatment of a long cloth continuously in which a cloth to be subjected to desizing, scouring and bleaching for the pretreatment thereof is preliminarily subjected to souring treatment in the sodium chlorite solution prepared by absorbing the chlorine dioxide gas, which is exhausted from the subsequent bleaching process with the use of chlorite, in a solution of $H_2O_2$ and NaOH, and accordingly it is possible to transport the long cloth continuously in the pretreating process speedily with no need of staying the cloth in folded state for increasing the productivity and improving the quality of the product, and further to render the pretreating apparatus compact so as suitable for the production of small lot products.

2 Claims, 3 Drawing Sheets

METHOD FOR CONTINUOUS PRETREATMENT OF A CLOTH

BACKGROUND OF THE INVENTION

1. Field of the Invention

The present invention relates to a method for continuous pretreatment of a long cloth in a short time in which a long cloth can satisfactorily be transported continuously without stagnation of the cloth in loading.

2. Description of the Related Art

For commercial production, the pretreatment of a long cloth conventionally comprises the steps of singeing, desizing, scouring and bleaching in succession. In the conventional continuous pretreatment of a long cloth, the cloth applied with bleaching and scouring agents is subjected to a wet heat treatment by stagnating the cloth in folded state in a wet heat treatment chamber in order to desize and scour the cloth in the first place, and then after the application of a bleaching agent to the thus desized and scoured cloth, the resultant cloth is subjected again to a wet heat treatment by stagnating the cloth in folded state for bleaching.

However, in such a pretreatment of a long cloth in the conventional practice, it requires a very long time as long as 30–40 minutes for a satisfactory wet heat treatment. Therefore, it is usual to stagnate a long cloth in folded state in a wet heat treatment chamber for the wet heat treatment in order to shorten the length of the chamber. With such stagnation for 30–40 minutes in folded state in this way, however, not only the productivity is naturally inferior, but also there occurs fold-creases and inconsistency of the treatment due to the fold-creases. In this way, there is a problem that a uniform and superior pretreatment can not be done all over the cloth to be treated.

Further, due to the fact that the reaction time of pretreatment is very long as above mentioned, the length of cloth to be treated staying in the pretreatment apparatus becomes very enormous. Therefore, such an apparatus becomes unavoidably large and is not suitable for the treatment of many kinds of cloth in small amounts.

SUMMARY OF THE INVENTION

Under such circumstances, the present invention has been made to solve these problems in the conventional art, and according to the present invention a cloth is subjected to a souring treatment prior to the treating steps of desizing, scouring and bleaching. As a result, the treating time of these steps can remarkably be shortened, and accordingly, it becomes possible to transport the cloth continuously with no need of folding the cloth in the course of the treatment of a long cloth. Thus, the present invention is to enhance the productivity and the quality of the pretreated cloth. Moreover, since the apparatus can be made compact, the present invention is suitable for the treatment of small lots of cloth.

More specifically, a cloth to be pretreated is subjected to the treatments of singeing and hot water washing, and the resultant cloth is subjected to a souring treatment for the purpose to shorten the treating time in the subsequent steps. After the souring steps, the steps of desizing, scouring and bleaching are done in succession. Chlorite (sodium chlorite, $NaClO_2$) is used for the bleaching. Thus, the continuous pretreatment of a long cloth can be done excellently.

Therefore, according to the present invention, due to the above mentioned souring process, the desizing and scouring steps, which are done thereafter, particularly the scouring step can be completed in a very short time, and accordingly, a continuous pretreatment of a long cloth can be done effectively with a superior quality in a short treating time of one sixth to one eighth (1/6–⅛) of the time required in the conventional pretreating method.

Particularly, in the present invention the souring agent to be applied in the souring treatment is obtained by recovering the chlorine dioxide gas exhausted from the chlorite bleaching step which is done after the souring process. Therefore, the cost of chemicals for the souring can largely be reduced.

The advantages of the present invention may be summarized as follows. Namely, since one of the most distinguished feature of the present invention is to subject the cloth to a souring treatment prior to the desizing, scouring and bleaching steps, the treating time of scouring and subsequent treatments can remarkably be shortened due to the effect of the souring treatment. Particularly, in the present invention, the treating solution to be applied to the souring treatment is based on the reuse of the recovered chlorine dioxide gas exhausted from the chlorite bleaching process which is done thereafter, so that the economy of the souring agent can remarkably be improved.

DETAILED DESCRIPTION OF THE PREFERRED EMBODIMENTS

EXAMPLE

In the following, the present invention will be described more in detail by referring to an example as shown in the figures.

Figure 1:
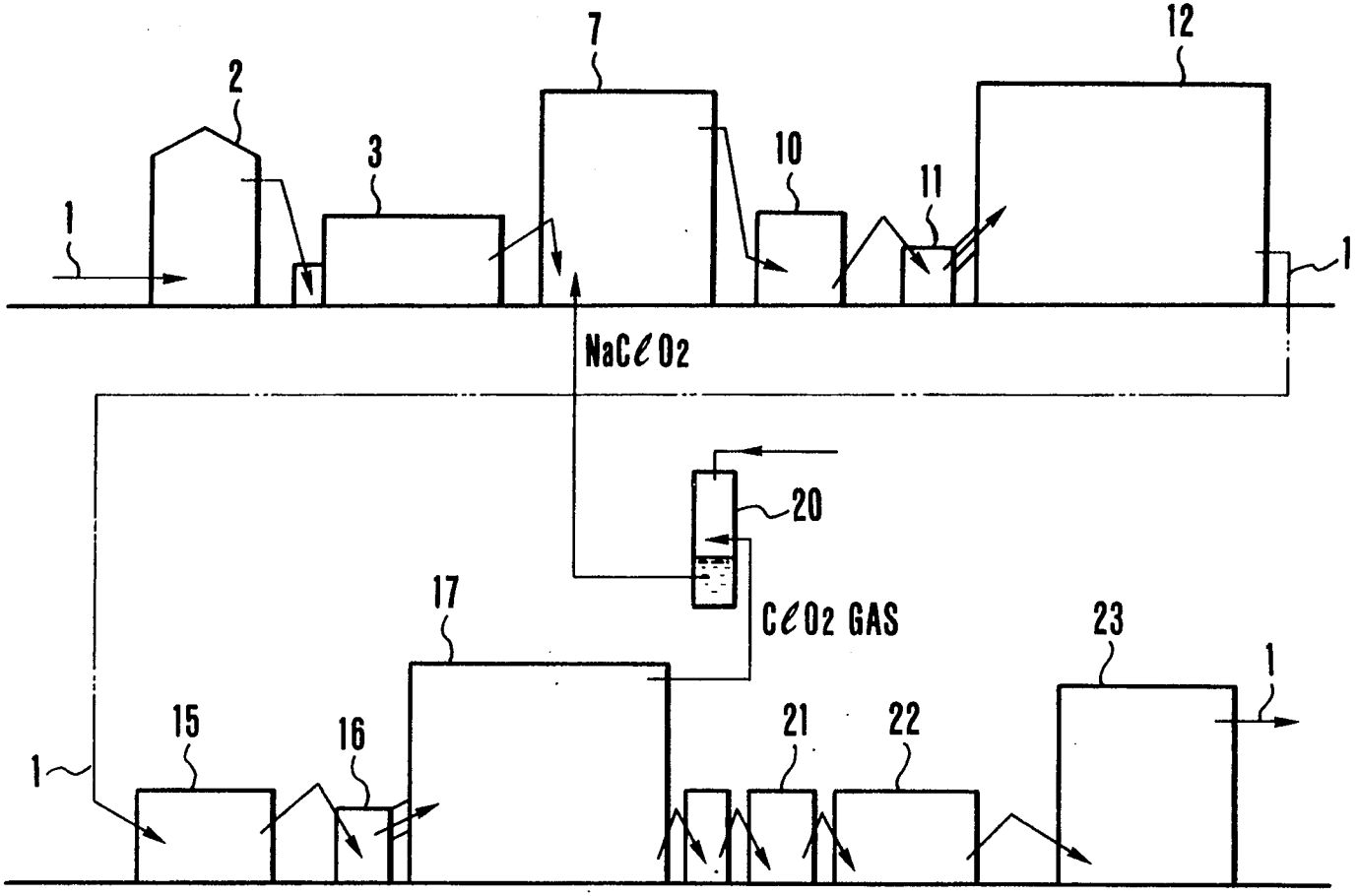
FIG. 1 is an explanatory drawing of the construction as a whole of the apparatus for carrying out the present inventive method.
Figure 2:
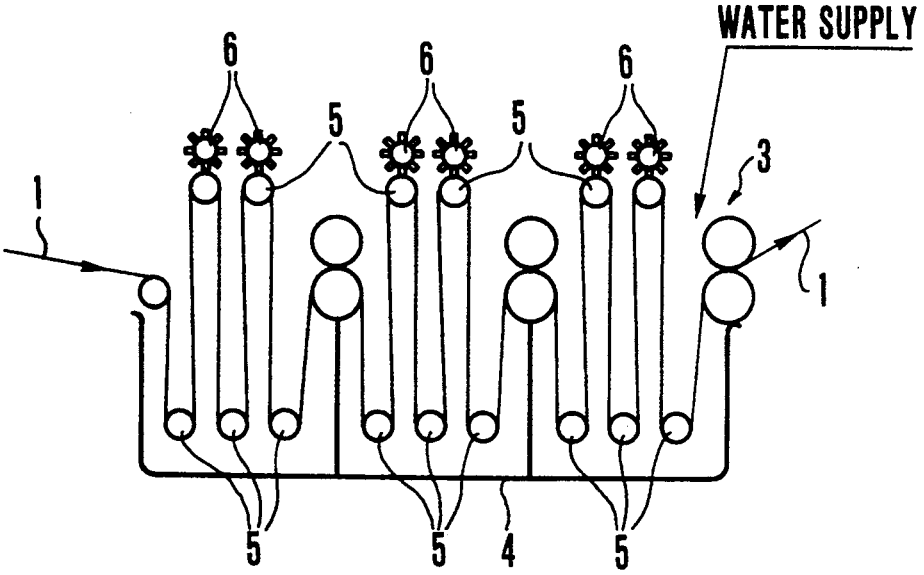
FIG. 2 is a detailed explanatory drawing of the washing chamber.

In FIG. 1, 1 is a long cloth to be pretreated. The cloth 1 is subjected first to singeing by using a gas-singeing machine 2 for burning off the fluffs on both sides of the cloth, and then to washing in a washing chamber 3 with the use of hot water 4 at about 80°–90° C. for about 20–30 seconds. The construction of the washing chamber 3 is as shown in FIG. 2. Namely, hot water 4 is introduced therein, and a plurality of guide rolls 5 are arranged at upper and lower portions for transporting the cloth up and down in zigzag through hot water. Further, an uneven roll 6 is contacted to each of the upper guide rolls. By controlling the peripherical speeds of the uneven roll 6 and the guide roll 5, the cloth 1 guided by the guide roll 5 receives friction force due to the uneven roll 6, and consequently the washing of the cloth due to hot water 4 in the washing chamber 3 can effectively be done. Thus, such impurities as PVA, starch and others adhering to the cloth 1 can effectively be washed.

Figure 3:
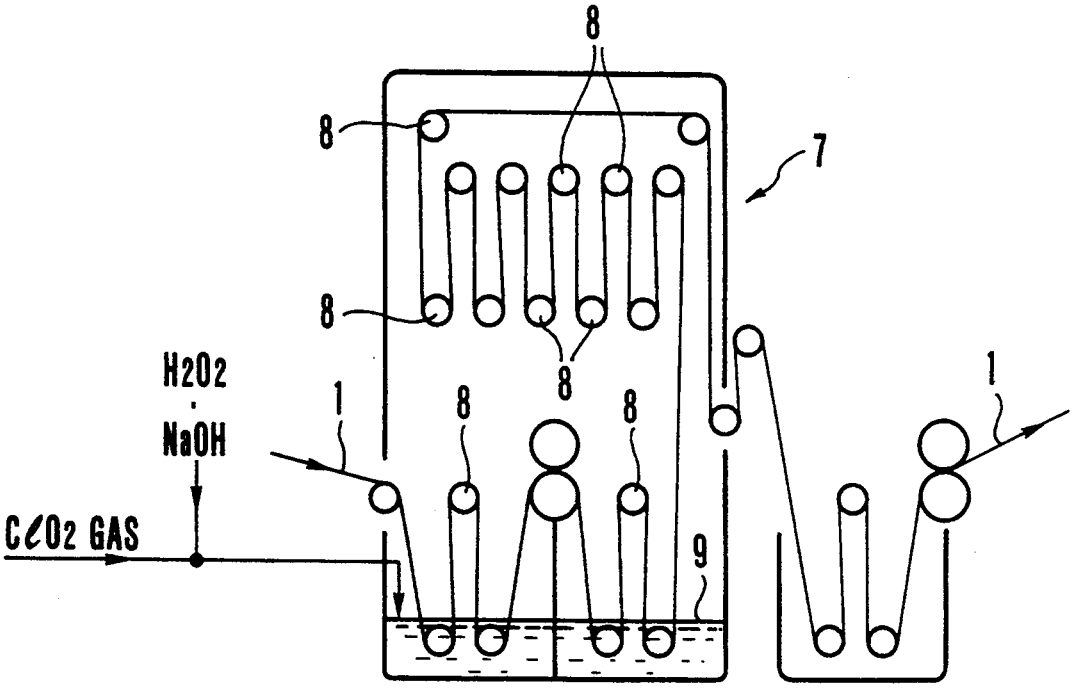
FIG. 3 is a detailed explanatory drawing showing the souring-treatment chamber.

The cloth washed in this way is introduced in a souring-treatment chamber 7. The construction of this souring-treatment chamber is as shown in FIG. 3. The chamber 7 is maintained with high humidity wet heat, for instance, at a temperature about 95° C., and is fitted with a plurality of guide rolls 8 so as to transport the cloth 1 in zigzag through the chamber. At the bottom part of the chamber, the souring-treatment solution 9 comprising sodium chlorite solution is introduced. Therefore, the cloth introduced in this souring-treatment chamber 7 is immersed in the sodium chlorite solution for about 20–30 seconds, and then steamed by means of the wet heat above the treating solution for about 30–60 seconds. Thus, the cloth receives the souring treatment, i.e., the preliminary scouring, and is introduced in the next washing chamber 10.

Figure 4:
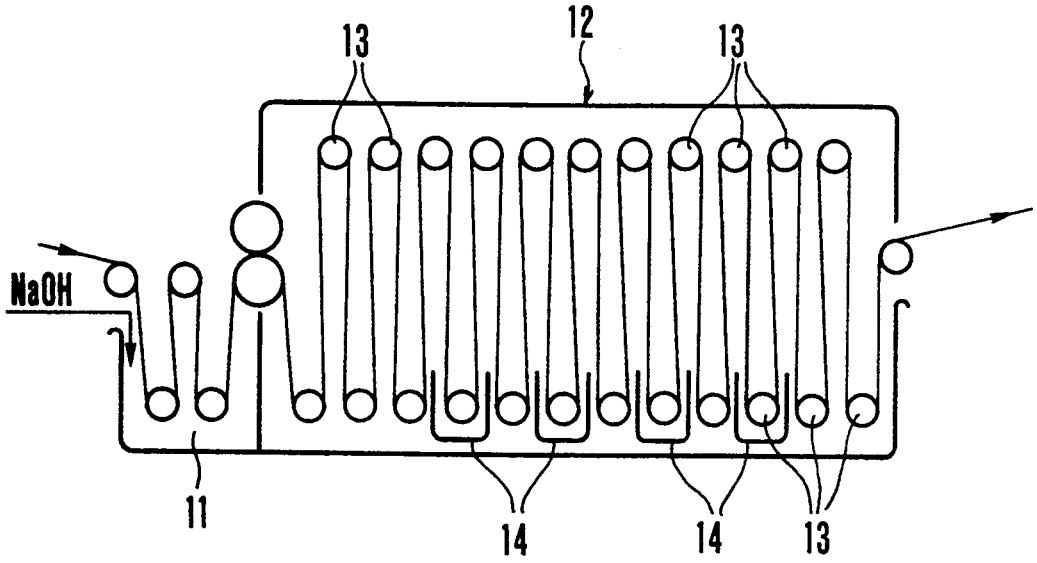
FIG. 4 is a detailed explanatory drawing showing the desizing an souring-treatment chamber.

Then, as shown in FIG. 1 the cloth washed in this washing chamber 10 is transferred to a liquid tank 11 for the application of a caustic soda solution thereto, and then introduced into a desizing and scouring-treatment chamber 12. In this chamber 12, the cloth is subjected to desizing and scouring-treatment by means of the action of steaming with the wet heat at a temperature of 80°–100° C. As shown in FIG. 4, this in desizing and scouring-treatment chamber 12, a plurality of guide rolls 13 are provided for transporting the cloth 1 up and down in zigzag with no folding, and a plurality of boosters 14 are arranged at the appropriate positions so as to supply a caustic soda solution to the cloth. The cloth passing through the desizing and scouring-treatment chamber 12 in about 1–2 minutes is desized and scoured with the use of the caustic soda solution and the wet heat treatment satisfactorily.

Figure 5:
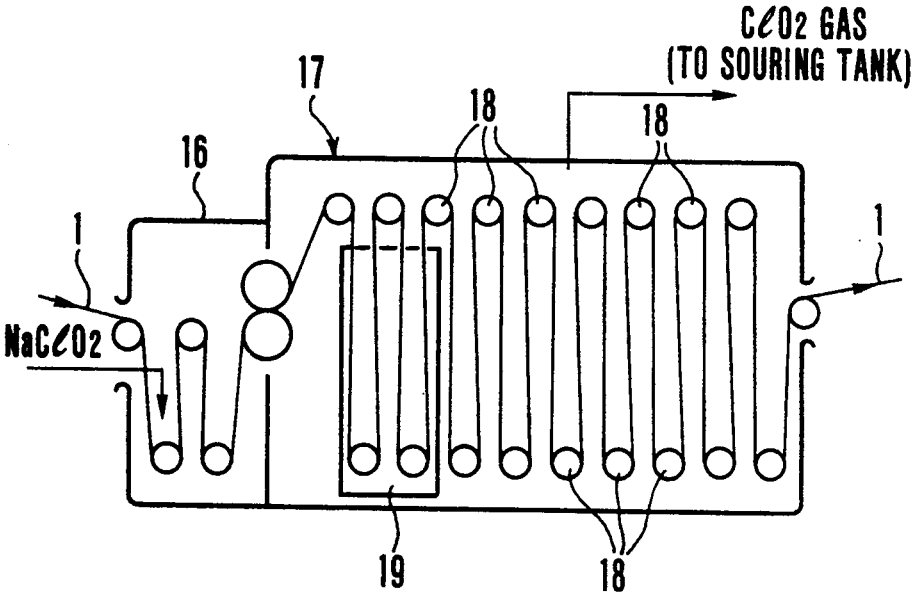
FIG. 5 is a detailed explanatory drawing of the bleaching treatment chamber.

The cloth taken out of the desizing and scouring-treatment chamber 12 is introduced via a washing chamber with hot water 15 into a hot water tank 16 containing a neutral sodium chlorite solution at a high temperature of, for instance, 80°–90° C. for the soaking thereof, and then supplied into a bleaching-treatment chamber 17. The construction of this bleaching-treatment chamber 17 is, as shown in FIG. 5, provided with a plurality of guide rolls 18 for transporting the cloth 1 up and down in zigzag with no folding and a steam tank 19 for the purpose to give acidic steam to the cloth supplied in this bleaching-treatment chamber 17. Therefore, it is possible that the cloth to which the sodium chlorite solution is given can be leached under the wet heat in about 1–2 minutes by receiving the acidic steam in the bleaching-treatment chamber 17 satisfactorily.

While chlorine dioxide gas is exhausted from the bleaching-treatment chamber 17, the thus exhausted chlorine dioxide gas is absorbed in a solution of $H_2O_2$ and NaOH to recover it as sodium chlorite in the gas-treatment chamber 20 as shown in FIG. 1, and the concentration of the thus recovered sodium chlorite solution is controlled to a definite value for the use as the souring-treatment agent in the previously described souring-treatment chamber 7.

The thus bleached cloth is subjected to dechlorination-treatment with the use of a sodium thiosulfate or hydrogen peroxide solution at a temperature of 80°–90° C. for about 10–20 seconds in a dechlorination-treatment chamber 21 as shown in FIG. 1. The cloth is further washed in a washing chamber 22 and finally dried by means of a cylindrical drier 23. Thus, the pretreatment of a cloth in object can satisfactorily be done.

What is claimed is:

1. A method for the continuous treatment of a long cloth comprising:

(A) subjecting the cloth to a souring treatment in a solution of sodium chlorite;

(B) subjecting the cloth from step (A) to a desizing treatment;

(C) subjecting the cloth from step (B) to a scouring treatment;

(D) subjecting the scoured cloth from step (C) to a bleaching treatment in a sodium chlorite solution; and (E) absorbing chlorine dioxide gas produced from the bleaching treatment in a solution of $H_2O_2$ and NaOH to produce sodium chlorite solution and using the thus produced sodium chlorite solution in the souring step.

2. A method according to claim 1 in which the souring treatment is carried out by immersing the cloth in the sodium chlorite solution for 20 to 30 seconds and then steaming the cloth for 20 to 30 seconds.

* * * * *